US007818922B2

(12) United States Patent
Ellis

(10) Patent No.: US 7,818,922 B2
(45) Date of Patent: Oct. 26, 2010

(54) THERMAL INSULATION FOR A BUILDING

(76) Inventor: Billy Ellis, 505 S. Burleson Rd., Burleson, TX (US) 76028

( * ) Notice: Subject to any disclaimer, the term of this patent is extended or adjusted under 35 U.S.C. 154(b) by 717 days.

(21) Appl. No.: 11/396,811

(22) Filed: Apr. 3, 2006

(65) Prior Publication Data

US 2006/0218869 A1 Oct. 5, 2006

Related U.S. Application Data

(60) Provisional application No. 60/667,395, filed on Apr. 1, 2005.

(51) Int. Cl.
*E04B 7/00* (2006.01)
*B32B 3/30* (2006.01)

(52) U.S. Cl. ..... 52/95; 52/198; 52/199; 52/302.3; 52/407.1; 52/407.3; 52/407.5; 52/408; 428/182; 428/158; 428/167; 428/319.1

(58) Field of Classification Search ..... 52/95, 52/198, 201.1, 404.1, 408, 409, 199, 220.4, 52/220.3, 220.5, 220.6, 302.3, 407.1, 407.3, 52/407.5; 428/71, 115, 156, 158, 167, 174, 428/309.9, 319.1, 319.14, 182
See application file for complete search history.

(56) References Cited

U.S. PATENT DOCUMENTS 1,028,725 A * 6/1912 Hodgson ..... 52/22
1,914,345 A 6/1933 Roos
2,015,817 A 10/1935 Schmidt
2,116,270 A 5/1938 Le Grand
2,318,820 A * 5/1943 Voigt et al. ..... 52/302.3
2,645,824 A * 7/1953 Titsworth ..... 52/302.3
3,160,987 A * 12/1964 Pinkley ..... 52/95
3,196,773 A * 7/1965 Lorenz et al. ..... 454/237
3,343,474 A 9/1967 Sohda et al.
3,368,473 A * 2/1968 Sohda et al. ..... 454/185
3,482,367 A * 12/1969 Curran ..... 52/309.9
3,616,139 A 10/1971 Jones
3,683,785 A * 8/1972 Grange ..... 454/250

(Continued)

FOREIGN PATENT DOCUMENTS

EP 0 553 414 A1 8/1993

(Continued)

*Primary Examiner*—Robert J Canfield
*Assistant Examiner*—Babajide Demuren
(74) *Attorney, Agent, or Firm*—Bracewell & Giuliani LLP

(57) ABSTRACT

An insulation system of a building having a plurality of spaced-apart support members has an insulator with a plurality of ribs are formed thereon. A concave portion of each rib receives one of the support members. A panel covers, and is secured to the support members. An exterior covering element is secured to an exterior side of the panel. A radiant heat barrier is bonded between the insulator and the panel. The insulator defines air ventilation channels between the foam insulator and the panel for venting air from building. An insulator assembly for a building has a sheet of foam insulation with a plurality of channels intermittently formed in the sheet of insulation. Each channel has a concave side and a convex side. The concave side is adapted to receive a support member of the building. A radiant heat barrier is bonded to a surface of the foam insulation.

16 Claims, 3 Drawing Sheets

U.S. PATENT DOCUMENTS 3,797,180 A * 3/1974 Grange ..... 52/95
3,972,164 A * 8/1976 Grange ..... 52/95
4,057,123 A 11/1977 Erickson
4,069,628 A * 1/1978 Kreimer ..... 52/94
4,096,790 A * 6/1978 Curran ..... 454/260
4,102,092 A * 7/1978 Ward ..... 52/95
4,125,971 A * 11/1978 Ward ..... 52/95
4,201,121 A 5/1980 Brandenburg, Jr.
4,214,510 A * 7/1980 Ward ..... 454/260
4,223,489 A * 9/1980 Bentley ..... 52/95
4,237,672 A * 12/1980 Peterson ..... 52/742.1
4,346,544 A * 8/1982 Larssen ..... 52/407.4
4,393,633 A * 7/1983 Charniga ..... 52/302.3
4,406,095 A * 9/1983 Slavik ..... 52/95
4,423,572 A * 1/1984 Tor ..... 52/94
4,446,661 A * 5/1984 Jonsson et al. ..... 52/95
4,660,463 A * 4/1987 Bottomore et al. ..... 454/260
4,677,903 A * 7/1987 Mathews, III ..... 454/185
4,736,561 A * 4/1988 Lehr et al. ..... 52/410
4,916,875 A * 4/1990 Kashiwagi ..... 52/302.3
4,942,711 A 7/1990 Bergquist
4,995,308 A * 2/1991 Waggoner ..... 454/260
5,341,612 A * 8/1994 Robbins ..... 52/95
5,522,195 A 6/1996 Bargen
5,596,847 A * 1/1997 Stephenson ..... 52/198
5,600,928 A * 2/1997 Hess et al. ..... 52/309.4
5,884,446 A * 3/1999 Hageman ..... 52/408
6,061,973 A * 5/2000 Accardi et al. ..... 52/90.1
6,061,978 A 5/2000 Dinwoodie et al.
6,088,992 A * 7/2000 Nunley ..... 52/783.19
6,141,932 A * 11/2000 Tarrant ..... 52/514
6,212,837 B1 * 4/2001 Davis et al. ..... 52/302.1
6,220,956 B1 4/2001 Kilian et al.
6,688,059 B1 * 2/2004 Walker ..... 52/302.3
6,780,099 B1 * 8/2004 Harper ..... 454/186
6,869,661 B1 * 3/2005 Ahr ..... 428/137
6,941,706 B2 * 9/2005 Austin et al. ..... 52/94
2003/0126806 A1 7/2003 Ellis
2004/0000113 A1 * 1/2004 Alderman ..... 52/407.5
2005/0072072 A1 * 4/2005 Duncan et al. ..... 52/198

FOREIGN PATENT DOCUMENTS

GB 2145756 A * 4/1985
JP 6-185130 7/1994

* cited by examiner

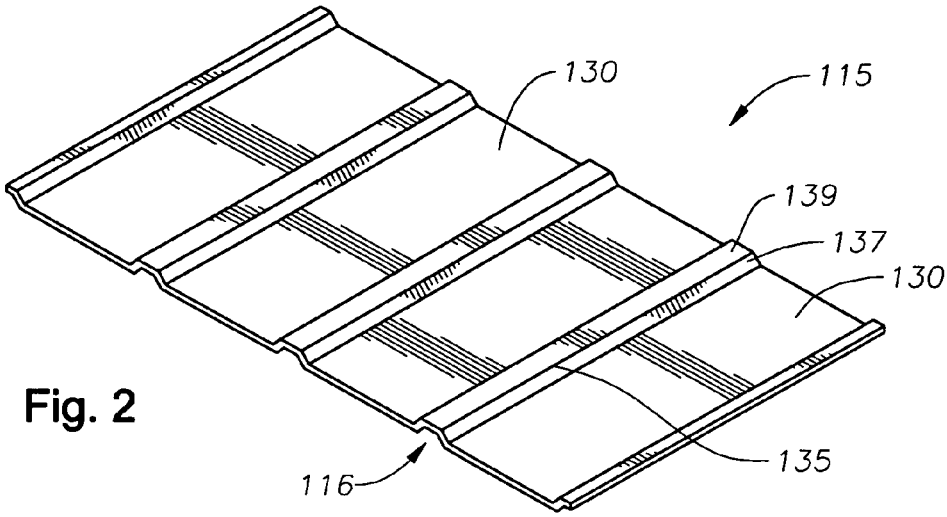
Fig. 2
Fig. 3
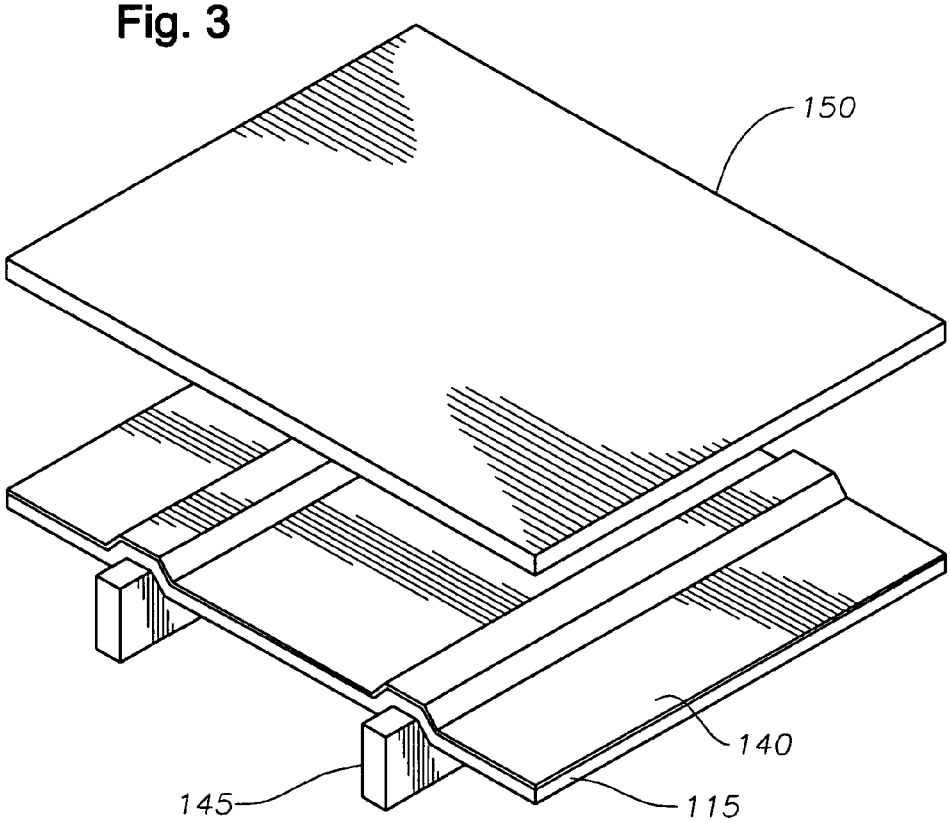

THERMAL INSULATION FOR A BUILDING

RELATED APPLICATIONS

This nonprovisional patent application claims the benefit of co-pending, provisional patent application U.S. Ser. No. 60/667,395, filed on Apr. 1, 2005, which is hereby incorporated by reference in its entirety.

BACKGROUND OF THE INVENTION

1. Field of the Invention

The invention relates generally to insulation for a building, and more particularly to insulated roof decking and wall insulation for the purpose of insulating the inside of a building from elements external to the building.

2. Background of the Art

The roof system of a conventional building generally includes uniformly spaced joists spanning the length between pairs of parallel support joists, where the joists form the ceiling. Wallboard and 2×6 boards can be placed on top of the uniformly spaced joists. Metal or wood trusses are then erected above the joists to form the framing for the roof. Exterior plywood sheathing is applied on top of the trusses and an exterior covering, such as a roofing felt and either asphalt, metal roofing, or wood shingles, is then secured to the exterior surface of the sheathing. Generally soffits or ventilated panels are installed to allow air to circulate freely, helping prevent problems with excessive heat or moisture inside the eaves and attic. However, such ceiling and roof systems can have less than desirable insulation properties.

BRIEF SUMMARY OF THE INVENTION

An insulation system of a building having a plurality of spaced-apart support members has a foam insulator. A plurality of ribs are formed on the insulator, and a concave portion of each rib receives one of the support members. A panel covers and is secured to the support members. An exterior covering element is secured to an exterior side of the panel. A radiant heat barrier is bonded between the foam insulator and the panel. The foam insulator defines a plurality of air ventilation channels between the foam insulator and the panel for venting air from building.

The exterior covering element of the insulation system can be an outer surface for a roof of the building or a wall of the building. The ribs can have by a pair of inclined sides connected by a crest. When foam insulator is positioned between the panel and the support members, the radiant heat barrier can be bonded to a surface of the foam insulator opposite from the concave portion of the ribs. When support members can also be positioned between the foam insulator and the panel, the radiant heat barrier can be bonded to a surface of the foam insulator having the concave portion of the ribs.

The insulation system can also have an internal covering element that covers a surface of the support members opposite from the panel. When the foam insulator is positioned between the support members and the internal covering element, the foam insulator and the internal covering element defines a supplemental air channel between the internal covering element and the foam insulator.

An insulator assembly for a building has a sheet of foam insulation with a plurality of channels intermittently formed in the sheet of insulation. Each channel has a concave side and a convex side. The concave side is adapted to receive a support member of the building. A radiant heat barrier is bonded to a surface of the foam insulation.

The sheet of foam insulation comprises generally uniform cross-section. The sheet of foam insulation can extend across a plurality of the support members of the building. The radiant heat barrier can be bonded to the surface of the sheet of foam insulation having the convex side of the channels. The radiant heat barrier can alternatively be bonded to the surface of the sheet of foam insulation having the concave side of the channels.

The surface of the sheet of foam insulation with the radiant heat barrier bonded thereto, can be adapted to be a surface of the sheet of foam insulation closest to an exterior of the building.

Each channel can be defined by a pair of inclined sides connected by a substantially flat crest, the crest being adapted to be secured to the support member. The portions of the sheet of foam insulation between each pair of ribs can be adapted to form air vents between the sheet of foam insulation and a panel covering the sheet of foam insulation.

BRIEF DESCRIPTION OF THE DRAWINGS

FIG. 2 is an isometric view of a panel of the thermal insulation assembly of FIG. 1

FIG. 3 is an isometric view of the panel thermal insulation assembly of FIG. 2, showing a sheet of plywood exploded from the panel.

DETAILED DESCRIPTION OF THE PREFERRED EMBODIMENT

Although the following detailed description contains many specific details for purposes of illustration, one having ordinary skill in the art will appreciate that many variations and alterations to the following details are within the scope of the invention. Accordingly, the exemplary embodiment of the invention described below is set forth without any loss of generality to, and without imposing limitations thereon, the claimed invention.

Figure 1:
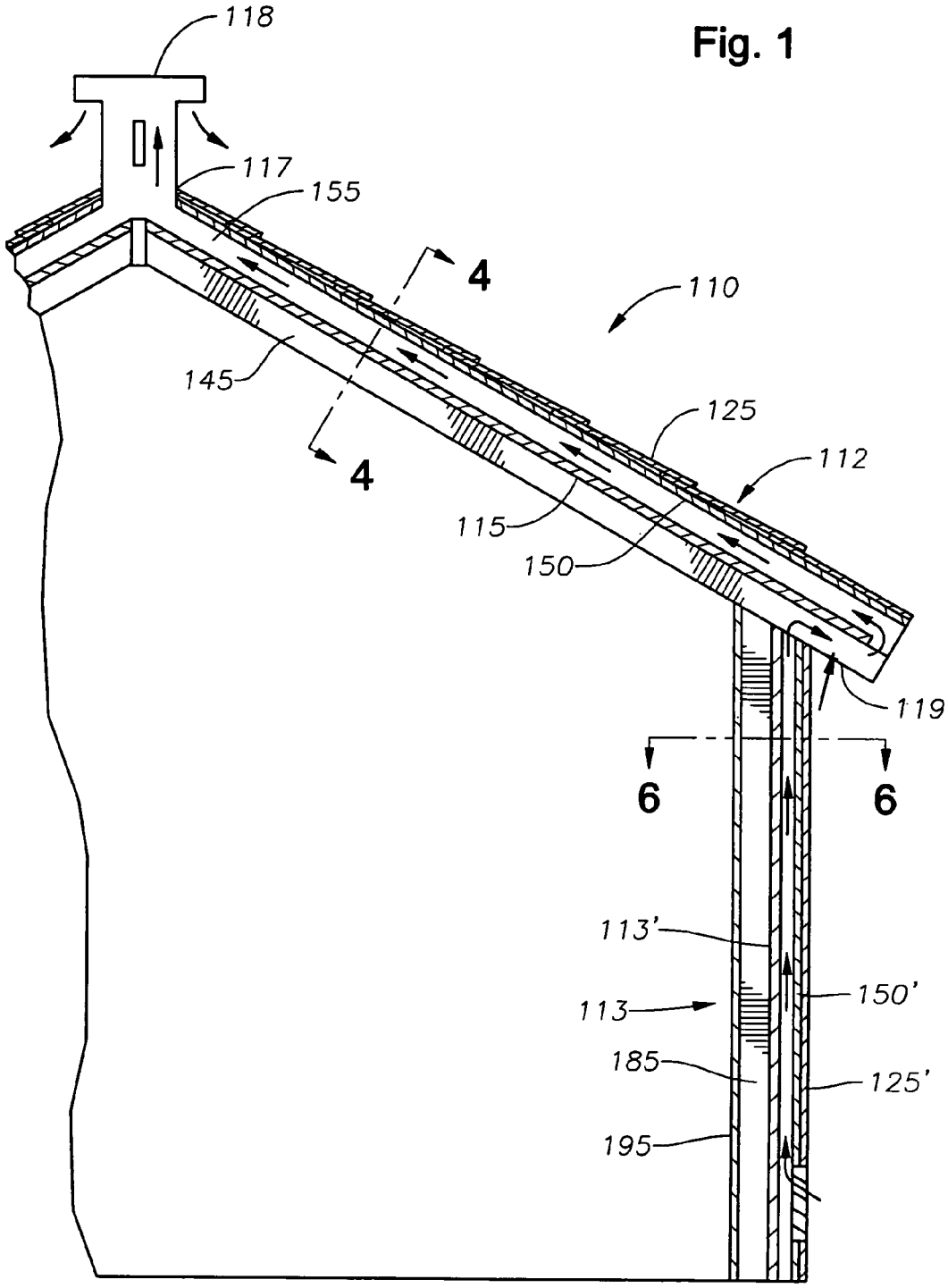
FIG. 1 is a partial sectional view building having a roof and wall portions with a thermal insulation assembly, constructed in accordance with the invention.

Referring to FIG. 1, an insulator or insulation panel 115 can be installed on part of a conventional roof 112 of a building 110. Insulation panel 115 extends from a top portion 117 of a roof 112 to a bottom soffit portion 119. Soffit portion 119 is a conventional structure that encloses the edge portions of roof 112. A conventional external surface element 125, such as shingles, can be installed on a top portion of roof 112 on top of plywood decking or panel 150 to interface environmental elements external to building 110. Insulation panel 115 can also be installed within a conventional wall 113 of building 110. For example, insulation panel 115 could be installed on the wall studs from the base or foundation to the house up to the top of wall 113 near soffit portion 119.

Figure 4:
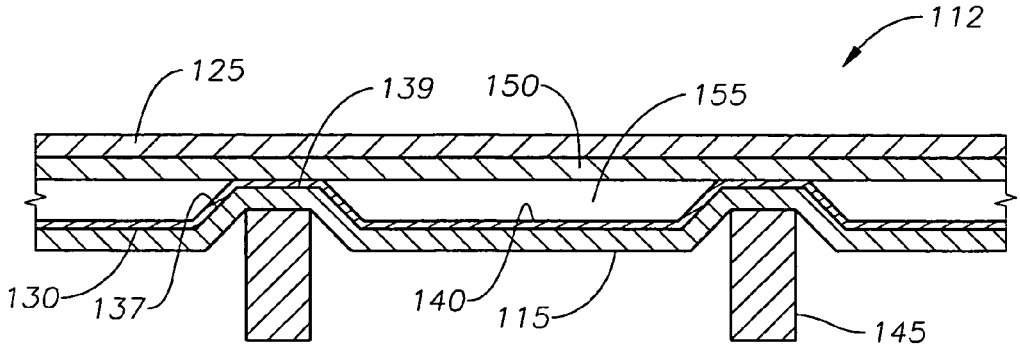
FIG. 4 is a sectional view of an embodiment of the roof portion of the building of FIG. 1, taken along line 11 of FIG. 1.

Referring to FIGS. 2-4, insulation panel 115 includes a longitudinal flat portion 130 with a plurality of ribs 135 protruding therefrom at various intervals along a length of insulation panel 115. Ribs 135 are transverse to a longitudinal direction of insulation panel 115, extending from soffit 119 to peak or upper portion 117. Each rib 135 in this embodiment is generally in the shape of a hat channel with a pair of tapered sides 137 and a flat crest 139. However, the configuration of ribs 135 could differ in other embodiments, such as for example, square ribs 135 or arcuate ribs 135. Also, insulation panels 115 can have smaller ribs 135 located between larger ribs 135. Ribs 135 result in a channel or groove 116 between each pair of longitudinal flat portions 130. Insulation panels 115 are preferably made of foam, but can also be made of plastics, or other suitable materials. Foam is preferably used because of the superior heat transfer properties provided by foam materials. A typical section of insulation panel 115 is about 8 feet longitudinally in length and about 4 feet wide. Ribs 135 protrude from flat portions 130 at intervals of about 2 feet measured from the center of one rib 135 to the center of an adjacent rib 135. The thickness of insulation panel 115 is preferably between about ½ inch and 1 inch, such as ¾ of an inch in the preferred embodiment of FIG. 2. Such dimensions and measurements can vary. Insulation panel 115 preferably comprises a foam, such as polystyrene.

A heat barrier 140, preferably thin sheet or layer of foil, is bonded to the external surface of the foam of insulation panel 115. Foil 140 is preferably bonded to an upper surface of on top of insulation panel 115 for insulating roof 112, and to an outer surface of insulation panel 115 for insulating wall 113. Foil 140 can be any material that radiates and conducts heat in a desired manner. Foil 140 is preferably aluminum foil, but can also be made of other metals or other suitable materials. Foil 140 is preferably a poor radiator but a good conductor of heat. For example, the emissivity value of aluminum foil 140 is roughly 3%, meaning that only 3% of the heat absorbed is given off in the form of radiant heat. On the other hand, 97% is given off by conduction through other less suitable materials in contact with foil 140 or by convection currents. By covering insulation panel 115 with foil 140, the radiation of heat from insulation panel 115 is greatly reduced and only a small percentage of heat conducted through insulation panel 115 and to foil 140 is allowed to radiate.

A plurality of joists 145 are part of conventional roof 112. Insulation panel 115 is preferably mounted on joists 145 of roof 112. Joists 145 are substantially parallel to and in alignment with each rib 135. In FIG. 4, an upper portion of each joist 145 contacts concave grooves 116 of each rib 135 to support and hold in place the insulation panel 115. In the preferred embodiment, joists 145 housed within the ribs 135 are transverse to the longitudinal direction of insulation panel 115.

Panel 150, which can be a substantially flat plywood sheet or a composite material sheet, is placed on the upper side of insulation panel 115. Panel 150 contacts foil 140 on flat crest 139 of each rib 135, creating an air ventilation channel 155 between foil 140 on insulation panel 115 and panel 150. Panel 150 is secured against foil 140 and flat crest 139 of each rib 135. Air ventilation channel 153 between insulation panel 115 and panel 150 provides additional insulation to the interior of building 110. Panel 150 preferably has approximately the same longitudinal length and width as insulation panel 115, with a thickness of approximately 1 inch, although dimensions and measurements can vary.

External surface element 125, such as a layer of shingles, is placed on top of panel 150. Shingles 125 constitute the external surface of roof 112 and interface with the environmental atmosphere external to building 110. As shown in FIG. 1, air ventilation channels 155 between insulation panel 115 and panel 150 communicate with vents 118 on peak 117 or near soffit 119. Lower vents can be installed near soffits 119 to allow air ingress or egress through air ventilation channels 155. Vents 118 can utilize convection currents for airflow, or power a wind-driven turbine. Air ventilation channels 155 and vents 118 help to remove heat from between insulation panel 115 and panel 150 so that the insulating material of insulation panel 115 is not damaged.

Figure 5:
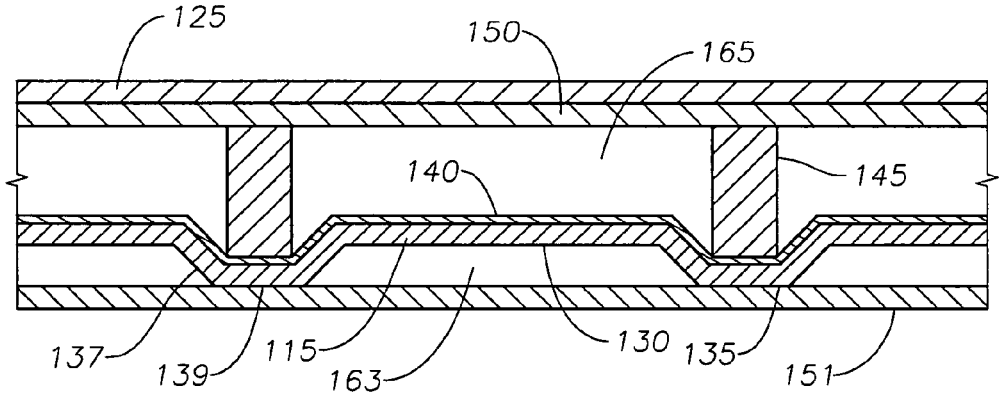
FIG. 5 is a sectional view of an alternative embodiment of the roof portion of FIG. 4.

FIG. 5 shows an alternative embodiment the insulation panel 115 as applied to the roof 112 of the building. Insulation panel 115 is secured to the underside of joists 145 instead of the upper surface of joists 145. The concave surface of each rib 135 engages the underside of joists 145. In this embodiment, foil 140 is positioned on the upper side of insulation panel 115, such that foil 140 is between joists 145 and insulation panel 115. Crest 139 of each rib 135 faces downward and contacts an internal support 151 of the roof 112. Internal support 151 is preferably comprised of flat sheets of material such as plywood, particle board, sheet rock, of some other composite material. An air ventilation channel 163 is defined between insulation panel 115 and internal support 151. The embodiment shown in FIG. 5 is especially useful for retrofitting a building having an existing roof with insulation panel 115.

In the embodiment of FIG. 5, panel 150 is connected to the upper, external surface of each joist 145. An air ventilation channel 165 is defined as the space between each pair of joists 145, foil 140, and panel 150. External surface 125 are positioned on top of panel 150 to interface with the environment or atmosphere external to the building.

Figure 6:
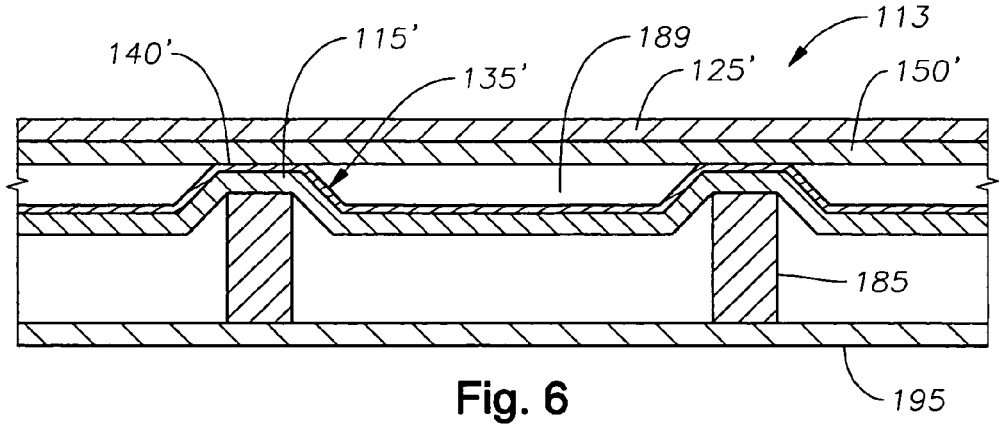
FIG. 6 is a sectional view of an embodiment of the wall portion of the building of FIG. 1, taken along the line 6-6 of FIG. 1.

Referring to FIG. 6, insulation panels 115' are mounted to an outer surface of conventional vertical studs 185 supporting wall 113 of building 110. The concave portions of ribs 135' register with studs 185. A flat panel 150', preferably comprising plywood, composite board, or particle board is connected to insulation panels 115' with foil 140' there between. An air ventilation channel 189 is defined between foil 140' lining insulation panel 115' and panel 150'. An external surface or veneer 125', such as brick or siding, can be positioned against panel 150'. Conventional fiberglass insulation (not shown) can be located between studs 185. An inner surface of each stud 185 contacts a sheet of wall board 195, such as for example, sheet rock.

Alternative embodiments to FIG. 6, for example, include a design similar to FIG. 5, except applied to vertical wall 113, where the insulation panels 115' are mounted to the inner surface of conventional vertical studs 185 of building 110.

A typical wall section of insulation panel 115' is about 8 feet longitudinally in length and about 4 feet wide. Ribs 135' protrude from flat portions 130' at intervals of about 16 inches measured from the center of one rib 135' to the center of an adjacent rib 135'. The thickness of the insulation panel 115' is preferably between about 12 inch and about 1 inch, and being about ¾ inch in the preferred embodiment. Such dimensions and measurements can vary. Other features described in FIGS. 1-5 are similar to this embodiment except that they are oriented along the wall 113.

The invention has several advantages. The thermal insulation is simple in design, and is efficient and economical to manufacture and use. It has improved insulation and heat transfer characteristics for residential, commercial, and industrial buildings. Although the invention herein described is intended primarily for use as decking or insulation on a roof or wall, it should be recognized that the thermal insulation can be used on any surface that requires superior insulating properties.

While the invention has been shown in some of its forms, it should be apparent to those skilled in the art that it is not so limited, but is susceptible to various changes without departing from the scope of the invention.

That claimed is:

1. An insulator system of a building having a roof with a plurality of spaced-apart support members, comprising:

an insulation sheet having a foam insulation layer having a lower side and an upper side;

the insulation sheet having a radiant heat barrier layer bonded in flush contact with an entire upper side of the foam insulation layer;

a plurality of ribs formed in the insulation sheet, each rib having a concave lower side and a convex upper side, with the concave lower side receiving and being fastened to an upper side of one of the support members of the building;

a flat roof panel secured to the support members over the insulation sheet, the roof panel being in flush contact with the convex upper sides of the ribs;

an exterior roof covering element secured to an upper side of the roof panel;

a ventilation channel having an upper surface defined by the roof panel, a lower surface defined by the heat barrier layer and side edges defined by the ribs that are adjacent each other such that radiant energy from exterior of the exterior roof covering element passes through the exterior roof covering element, the roof panel and the ventilation channel and strikes the heat barrier layer without passing through another heat barriers layer; and at least two roof vents on the building in communication with opposite ends of the ventilation channel for venting air from the channel.

2. The insulator system of claim 1, wherein the portion of the insulation sheet between adjacent ones of the support members is free of any of the ribs.

3. The insulator system of claim 1, wherein each of the ribs is defined by a pair of inclined sides connected by a substantially flat crest, the crest being secured to the upper side of one of the support members.

4. The insulator system of claim 1, wherein the heat barrier layer is also bonded to the ribs.

5. The insulator system of claim 1, wherein the insulation sheet has a uniform thickness throughout.

6. An insulation system of a building having a plurality of spaced apart support members, comprising:

an insulation sheet having on an inner side foam insulation layer and on an outer side a radiant heat barrier layer bonded in flush contact with an entire outer side of the foam insulation layer, the insulation sheet having a plurality of straight, parallel ribs formed thereon, the ribs extending in a first direction from opposite edges of the insulation sheet, the insulation sheet having intermediate portions between adjacent ones of the ribs that are within a single plane and free of any disruptions, each of the ribs having a concave portion and convex portion, the concave portion of each rib receiving one of the support members, the ribs being spaced apart from each other a distance equal to a distance between two adjacent ones of the support members, such that there are no ribs located between the support-members;

an exterior covering element secured to the support members on an exterior side of the insulation sheet, the exterior covering element being spaced from the heat barrier layer on the intermediate portions of the insulation sheet, defining a plurality of air ventilation channels between the heat barrier layer on the intermediate portions of the insulation sheet and the exterior covering element; and at least two vents on the building in communication with opposite ends of the air ventilation channels for venting air from the channels.

7. The insulation system of claim 6, wherein the exterior covering element comprises an outer surface for a roof of the building.

8. The insulation system of claim 6, wherein the exterior covering element comprises an outer surface for a wall of the building.

9. The insulation system of claim 6, wherein the insulation sheet is positioned between the exterior covering element and the support members.

10. The insulation system of claim 6, wherein the support members are positioned between the insulation sheet and the exterior covering element.

11. The insulation system of claim 10, further comprising an internal covering element covering a surface of the support members opposite from the exterior covering element, and wherein the inner side of the intermediate portion of the insulation sheet is spaced from the internal covering element, defining supplemental ventilation channels.

12. The insulation system of claim 6, wherein each of the ventilation channels has an inner side and an outer side, the outer side being defined by the exterior covering element, the inner side being defined by the heat barrier sheet layer and being the only side containing the heat barrier sheet layer, such that heat energy from exterior of the exterior covering element passes through the exterior covering element and the ventilation channels and strikes the heat barrier layer without being deflected by another heat barrier layer.

13. An insulation system of a building having a plurality of spaced-apart roof support members, comprising:

a foam roof insulator panel having a plurality of ribs formed thereon with each of the ribs having a concave portion and a convex portion, the concave portion of each rib receiving one of the roof support members;

a roof panel covering and secured to upper edges of the roof support members;

an exterior roof covering element-secured to an upper side of the roof panel;

a radiant heat barrier sheet bonded in flush contact to an upper side of the foam roof insulator panel;

the portions of the heat barrier sheet between the roof support members being spaced from a lower side of the roof panel, defining a roof air ventilation channel between adjacent ones of the roof support members and the lower side of the roof panel, the lower side of the roof panel between adjacent ones of the roof support members being free of contact with any type of heat barrier sheet;

at least one roof vent on the building in communication with the roof air ventilation channels for venting air from the channels; wherein:

the insulator panel is secured to lower edges of the roof support members; and the portion of the insulator panel between the adjacent ones of the roof support members spaced closer to the roof panel than the lower edges of said adjacent ones of the roof support members.

14. The insulation system of claim 13, wherein an, upper surface of the crest in the concave portion of each of the ribs engages a lower edge of one of the roof support members.

15. The insulation system of claim 13, further comprising:

a plurality of spaced-apart wall support members;

a foam wall insulator panel haying a plurality of ribs formed thereon with each of the ribs having a concave portion and a convex portion, the concave portion of each rib receiving one of the support members;

an exterior wall covering secured to the support members;

a radiant heat barrier sheet bonded in flush contact to an exterior side of the foam wall insulator panel;

the portion of the heat barrier sheet between the ribs being spaced inward from an inner side of the exterior wall covering, defining a wall air ventilation channel between adjacent ones of the wall support, members and the exterior wall covering, and the inner side of the exterior wall covering between adjacent ones of the wall support members being free of contact with any type of heat barrier sheet; and the wall air-vent channels being in communication with the roof air ventilation channels for venting through the roof vent.

16. The insulation system of claim 13, wherein a portion the foam insulator panel between adjacent ones of the support members is flat and free of any of the ribs.

* * * * *